US005304088A

United States Patent [19]

Suimon

[11] Patent Number: 5,304,088

[45] Date of Patent: Apr. 19, 1994

[54] DRIVE APPARATUS FOR VEHICLE TOY

[75] Inventor: Yoshio Suimon, Tokyo, Japan

[73] Assignee: Kabushiki Kaisha Hanzawa Corporation, Tokyo, Japan

[21] Appl. No.: 45,634

[22] Filed: Apr. 9, 1993

[30] Foreign Application Priority Data

Aug. 31, 1992 [JP] Japan ..... 4-231012

[51] Int. Cl.[5] ..... A63H 29/00; A63H 17/36

[52] U.S. Cl. ..... 446/443; 446/463; 446/460; 74/384; 74/810.1; 180/6.66

[58] Field of Search ..... 446/443, 460, 463, 456, 446/462; 74/665, 384, 810.1; 180/6.66, 6.2

[56] References Cited

U.S. PATENT DOCUMENTS 4,577,528 3/1986 Hazawa ..... 446/443 X 4,655,724 4/1987 Law ..... 446/443

FOREIGN PATENT DOCUMENTS 694084 7/1940 Fed. Rep. of Germany ..... 446/463

*Primary Examiner*—Mickey Yu

*Attorney, Agent, or Firm*—Drucker & Sommers

[57] ABSTRACT

When an electric motor is rotated normally, a left-hand driving wheel is rotated normally by a drive gear through a large gear, a left-hand small gear, and a left-hand driven gear, and a right-hand driving wheel is also rotated normally through a right-hand small gear, a swing gear, an intermediate gear, and a right-hand driven gear, thereby causing the vehicle toy to run straight. When the electric motor is switched to a reverse rotation, the left-hand driving wheel is rotated reversely, and the swing gear is brought into engagement directly with the right-hand driven gear to rotate the right-hand driving wheel normally. As a result, the vehicle toy makes a continuous turn at a small radius of rotation. Since the swing gear is turnably attached to a switch arm which is capable of turning about a gear shaft of the large gear, the swing gear is moved in accordance with the normal rotation and reverse rotation of the right-hand small gear, and brought into engagement with either of the intermediate gear and the right-hand driven gear.

1 Claim, 2 Drawing Sheets

DRIVE APPARATUS FOR VEHICLE TOY

BACKGROUND OF THE INVENTION

This invention relates to a drive apparatus for a vehicle toy having a pair of driving wheels such as an automatic vehicle toy.

There is known a drive apparatus for a vehicle toy, in which a pair of driving wheels are rotated in a same direction by an electric motor mounted on a body of the vehicle toy through a transmission unit in order to run the vehicle toy straight, and in which one of the driving wheels is rotated by the electric motor while keeping the other wheel stopped in order to cause the vehicle toy to make a continuous turn or a U-turn.

However, the above conventional drive apparatus for a vehicle toy has the shortcoming that since the vehicle toy is caused to make a continuous turn or a U-turn by rotating one of the driving wheels and keeping the other stopped, a radius of rotation of the vehicle toy becomes large.

SUMMARY OF THE INVENTION

It is therefore a general object of the present invention to provide, in order to obviate the above shortcoming, a drive apparatus for a vehicle toy which is capable of making a continuous turn of a vehicle toy at a small radius of rotation and positively switching a mode for making a straight running of the vehicle toy over to a mode for making a continuous turn and vice versa.

Another object of the present invention is to provide a drive apparatus for a vehicle toy which is not only simple in structure but also inexpensive.

To achieve the above objects, according to the present invention, there is essentially provided a drive apparatus for a vehicle toy comprising an electric moor capable of rotating normally and reversely, a transmission gear unit adapted to transmit driving force of the electric motor to a left-hand and a right-hand drive shafts, and a pair of driving wheels firmly secured to one ends of the drive shafts respectively, the transmission unit comprising a large gear engaged with a drive gear which is firmly secured in one end of a rotary shaft which supports the electric motor, a left-hand and a right-hand small gears respectively disposed at both sides of the large gear and integral with the large gear, two driven gears disposed one at the left-hand drive shaft and the other at the right-hand drive shaft, one of the driven gears disposed at either of the left-hand and the right-hand drive shafts being in engagement with either of the left-hand and the right-hand small gears, a switch arm rotatably supported on the large gear and the left-hand and right-hand small gears and capable of turning about a shaft supporting the large gear and the left-hand and right-hand small gears, and a swing gear rotatably supported by the switch arm in such a manner as to be capable of turning about a shaft of the switch arm and engaged with the other small gear, the swing gear being disposed between the other driven gear disposed at the other drive shaft and the intermediate gear engaged with the other driven gear, the swing gear being engaged with the intermediate gear when the electric motor is rotating normally, the swing gear being engaged with the other driven gear when the electric motor is rotating reversely.

With a drive apparatus for a vehicle toy thus constructed, when the electric motor is rotated normally, one driving wheel is rotated normally by the drive gear firmly secured to one end of the rotary shaft supporting the electric motor through the large gear, one of the left-hand and right-hand small gears, one of the driven gears, one of the driving wheels, and one of the drive shafts, and at the same time, the other driving wheel is likewise rotated normally in the same direction as the one driving wheel, through the large gear, the remaining one of the small gears, the swing gear, the intermediate gear, the remaining one of the driven gears, and the remaining one of the drive shafts. As a result, the vehicle toy runs straight.

When the electric motor is rotated reversely, one driving wheel is rotated reversely by the drive gear through those members as in the normal rotation, and at the same time, the other driving wheel is rotated normally through the large gear, the other small gear, the swing gear, the other driven gear, and the other drive shaft. As a result, the vehicle toy makes a continuous turn. Since the radius of rotation for such a continuous turn or a U-turn can be made small when compared with the conventional toy in which one of the driving wheels is rotated and the other is kept stopped.

Furthermore, the vehicle toy can be switched between a mode for running straight and a mode for making a continuous turn by rotating a single electric motor normally and reversely so as to bring, when in normal rotation, the swing gear engaged with the other small gear fixed to the large gear and rotatably supported by the switch arm into engagement with the other driven gear through the intermediate gear, and to bring, when in reverse rotation, the swing gear into engagement directly with the other driven gear. Since an electromagnetic clutch and two electric motors are not used, the construction becomes simple.

Moreover, the switch arm is supported on the large gear and the left-hand and the right-hand small gears in such a manner as to be capable of turning about the shaft supporting these gears, the swing gear is rotatably attached to the switch arm in such a manner as to be capable of turning about the shaft of the switch arm, and the swing gear is engaged with the other small gear. Accordingly, in accordance with the normal or reverse rotation of the small gear, the swing gear is turned about the shaft of the switch arm while rotating about its axis and positively engaged with the intermediate gear and the driven gear. Therefore, a stable switching operation can be obtained.

DETAILED DESCRIPTION OF THE EMBODIMENT

One embodiment of the present invention will described hereinafter with reference to the accompanying drawings.

Figure 1:
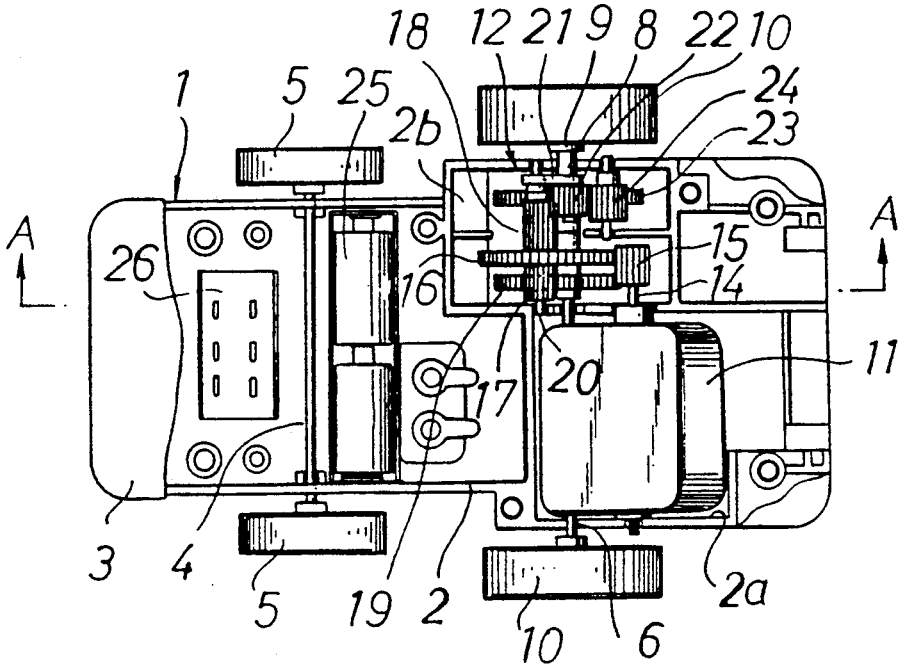
FIG. 1 is a plan view, partly cutaway, of a drive apparatus according to one embodiment of the present invention, which is mounted on a vehicle toy.
Figure 2:
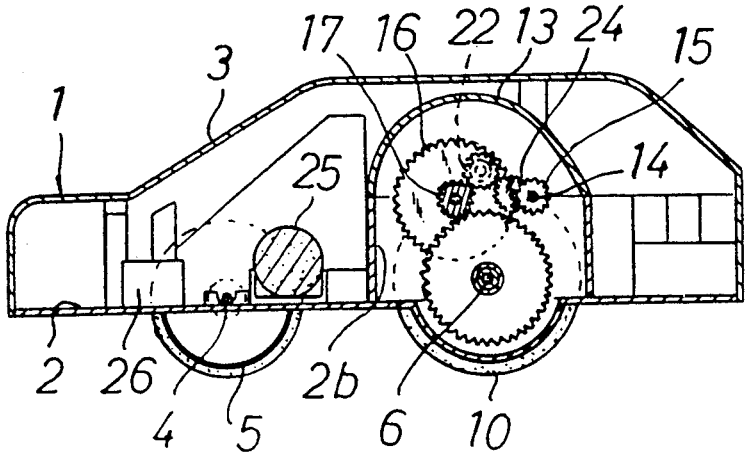
FIG. 2 is a vertical cross-sectional side view of the drive apparatus taken on line 3—3 of FIG. 1.

FIGS. 1 and 2 illustrate a drive apparatus according to one embodiment of the present invention which is mounted on an automatic vehicle toy.

In FIGS. 1 and 2, the numeral 1 denotes a vehicle body including a chassis and a body member. The vehicle body 1 comprises a lower body element 2 and an upper body element 3 both of which are formed of a molded member of a synthetic resin material and fixed by screws.

A front axle 4 is disposed across a front portion of the lower body element 2. A pair of front wheels 5 having rubber tires respectively are rotatably attached to both ends of the front axle 4 projecting from the lower body element 2, such that the front wheels 5 are not disengaged therefrom.

Figure 3:
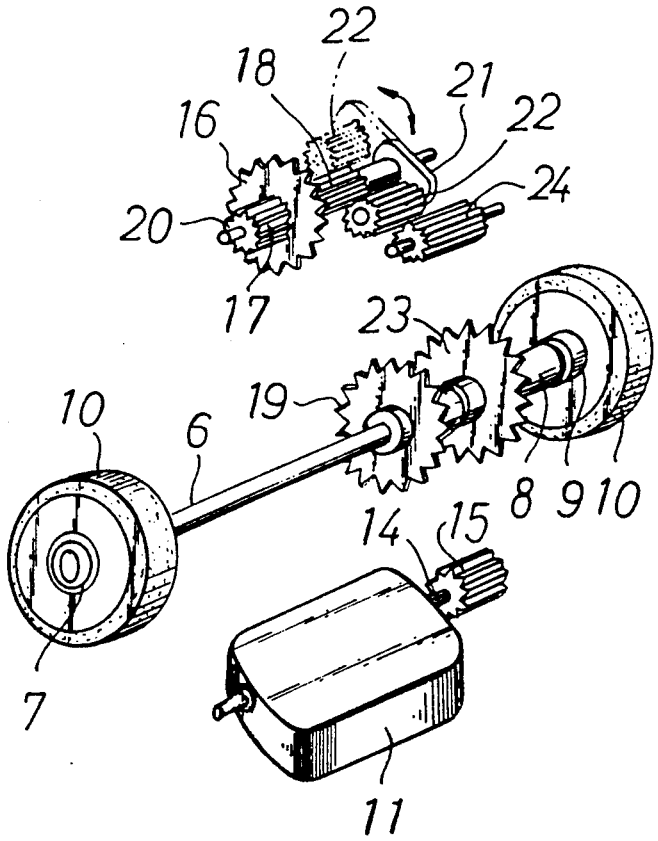
FIG. 3 is an exploded perspective view showing an important portion of the drive apparatus of FIG. 1.

A left-hand drive shaft 6 is disposed at a rear portion of the lower body element 2 in such a manner as to be in parallel relation to the front axle 4. A left-hand driving wheel 7 is fixedly attached to a left-hand end portion projecting inwardly of the lower body element 2 of the left-hand drive shaft 6. As also shown in FIG. 3, a right-hand drive shaft 8 is rotatably engaged with a right-hand end portion of the left-hand drive shaft 6, and the right-hand drive shaft 8 is disposed coaxial with the left-hand drive shaft 6. A right-hand driving wheel 9 is attached to a right-hand end portion of the right-hand drive shaft 8 projecting rightwardly of the lower body element 2. The left-hand and right-hand drive shafts 6 and 8 are restricted in axial movement. Rubber tires 10 and 10 are fixedly attached respectively to the left-hand and the right-hand driving wheels 7 and 9.

A small type horizontal electric motor 11, which can be rotated normally and reversely by switching pole, is supported on an upper left-hand side of a rear part o the lower body element 2. A transmission gear unit 12 is disposed on a left-hand side of the electric motor 11 and adapted to transmit driving force to the left-hand and the right-hand drive shafts 6 and 8. Those potions of the left-hand and the right-hand drive shafts 6 and 8 located above the lower body element 2, as well as a cover member 13 covering the electric motor 11 and the transmission gear unit 12, are removably attached onto the lower body element 2 by screws.

In the transmission gear unit 12, a drive gear 15 is firmly secured to one end of a rotary shaft 14 projecting rightwardly of the electric motor 11, and a large gear 16 is in engagement with the drive gear 15. A left-hand and a right-hand small gears 17 and 18 are disposed on both sides of the large gear 16 in such a manner as to be coaxial and integral with the large gear 16. A leftward driven gear 19, which is firmly secured to a right-hand end of the left-hand drive shaft 6, is in engagement with the left-hand small gear 17.

A gear shaft 20 supporting the large gear 16 and the left-hand and the right-hand small gears 17 and 18 extends in a transverse direction (rightwardly and leftwardly) of the vehicle toy. A basal end portion of a switch arm 21 is turnably attached to a rightwardly projected portion of the gear shaft 20, and a swing gear 22 is axially rotatably attached to a shaft 22*a* on the distal end portion of the switch arm 21. The swing gear 22 is in engagement with the right-hand small gear 18 and disposed between a rightward driven gear 23 integral with the right-hand drive shaft 8 and an intermediate gear 24 which is in engagement with a rear part of the rightward driven gear 23 and axially rotatable. When the electric motor 11 is rotated normally, the swing gear 22 is brought into engagement with the intermediate gear 24. In contrast, when the electric motor 11 is rotated reversely, the swing gear 22 is brought into engagement with a front part of the rightward driven gear 23.

The drive gear 15, the left-hand and right-hand small ears 1 and 18, the swing gear 22, and the intermediate gear 24 have the same teeth number with one another. The leftward and the rightward gears 19 and 23 have the same teeth number with each other, but this teeth number is greater than that of the drive gear 15, etc.

The electric motor 11 is received in and supported by a recess 2*a* opened to an upper surface of the lower body element 2 at both end potions thereof, and fixedly pressed into the recess 2*a* by the cover 13 which is secured onto the lower body element 2 by screws. The left-hand and the right-hand drive shafts 6 and 8, the gear shaft 20 supporting the large gear 16 and the left-hand and the light small gears 17 and 18, and the gear shaft supporting the swing gear 22 are respectively received in and supported by the recess 2*a* opened to the upper surface of the lower body element 2 such that their forward and backward movements are restricted, respectively. They are also restricted in their vertical movements by the cover 13 which is firmly secured onto the lower body element 2 by screws.

The lower body element 2 is provided with a power source 25 such as a small type chargeable accumulator or dry cells, and a control unit 26 which is operated to switch the mode between an ON-state and an OFF-state and also to switch the mode between a normal rotation and a reverse rotation, both through a remote control of a radio control type. The power source 25 is connected to the electric motor 11 through the control unit 26.

Operation of this embodiment will now be described.

When the commands of "ON" and "normal rotation" are given to the control unit 26 by means of remote control, the drive gear 15 is rotated counterclockwise together with the rotary shaft 14 supporting the electric motor 11 which is connected to the power source 25, and the large gear 16 engaged with the drive gear 15 is rotated clockwise in unison with the left-hand and the right-hand small gears 17 and 18. As a result, the leftward driven gear 19 engaged with the small gear 17 is rotated counterclockwise, and the leftward drive shaft 6 and driving wheel 7 are also rotated counterclockwise in unison.

Upon clockwise rotation of the right-hand small gear 18, the swing gear 22 engaged with the small gear 18 is rotated counterclockwise. In the case where the swing gear 22 is in engagement with the intermediate gear 24, the intermediate gear 24 is directly rotated clockwise. In the case where the swing gear 22 is not in engagement with the intermediate gear 24, the swing gear 22 is rotated counterclockwise and at the same time, the switch arm 21 is turned clockwise about the gear shaft 20. As a result, the swing gear 22 is brought into engagement with the intermediate gear 24 to cause the latter to rotate clockwise. When the intermediate gear 24 is rotated clockwise, the rightward driven gear 23 engaged with this intermediate gear 24 is rotated counterclockwise at an equal speed as the leftward driven gear 19, and the rightward drive shaft 8 and driving wheel 9 are rotated counterclockwise in unison.

When the leftward and the rightward driving wheels 7 and 9 are rotated counterclockwise together, the tires 1 fixed to the wheels 7 and 9 cause the automatic vehicle toy to run straight.

When the swing gear 22 is not in engagement with the intermediate gear 24, only the leftward driving wheel 7 is rotated counterclockwise until the swing gear 22 is brought into engagement with the intermediate gear 24. Although the automatic vehicle toy is turned rightwardly during that time, the amount of turn is negligibly small.

When a command of reverse turn is given to the control unit 26 by the remote control while the automatic vehicle toy is running straight, the flowing direction of electric current in the electric motor 11 is reversed. As a result, the drive gear 15 is rotated clockwise together with the rotary shaft 14, and the large gear 16 and the left-hand and the right-hand small gears 17 and 18 are rotated counterclockwise in unison, and the driven gear 19 and the leftward drive shaft 6 and driving wheel 7 are rotated clockwise in unison. Upon counterclockwise rotation o the small gear 18, since the swing gear 22, while rotating clockwise, is turned about the gear shaft 20 and brought into engagement with the rightward driven gear 23. As a result, the driven gear 23 is rotated counterclockwise together with the rightward drive shaft 8 and driving wheel 9.

As described above, the leftward driving wheel 7 is rotated clockwise to attempt to run the automatic vehicle toy backwardly by the tire 10, and the rightward driving wheel 9 is rotated counterclockwise to attempt to run the automatic vehicle toy forwardly by the tire 10. As a result, the automatic vehicle toy is continuously turned leftwardly.

Therefore, according to this embodiment, the automatic vehicle toy can be rotated at a small radius of rotation when compared with the conventional automatic vehicle toy in which the leftward driving wheel is kept stopped and the rightward driving wheel is rotated forwardly. Further, by giving a command of a normal rotation to the control unit 26 at a proper timing and making the automatic vehicle toy run forwardly, this toy can be caused to make a turn by 90 degrees so as to run forwardly and leftwardly, and also can be caused to make a U-turn. Furthermore, by giving a stop command to the control unit 26 while the automatic vehicle toy is running straight or making a continuous turn, the supply of electric current to the electric motor 11 can be cut off so as to stop the automatic vehicle toy.

By attaching a caterpillar belt or crawler belt to a vehicle toy instead of attaching tires to the driving wheels as in the embodiment, the present invention can likewise be applied to a catapillar type vehicle toy such as a tractor toy.

The present invention is not limited to a remote control means of a radio control type, but it may be operated by a remote control means of a wire control type or the like.

As described in the foregoing, a drive apparatus for a vehicle toy according to the present invention such as an automatic vehicle toy, comprises a transmission gear unit adapted to transmit driving force of an electric motor rotating normally and reversely to driving wheels attached respectively to one ends of a left-hand and a right-hand drive shafts, the transmission unit comprising a large gear engaged with a drive gear which is firmly secured to one end of a rotary shaft of the electric motor, a left-hand and a right-hand small gears respectively disposed at both sides o the large gear and integral with the large gear, two driven gears disposed one at a left-hand drive shaft and the other at a right-hand drive shaft, one of the driven gears disposed at either of the left-hand and the right-hand drive shafts being in engagement with either of the left-hand and the right-hand small gears, a switch arm rotatably supported on the large gear and the left-hand and the right-hand small gears and capable of turning about a shaft supporting the large gear and the left-hand and the right-hand small gears, and a swing gear rotatably supported by the switch arm in such a manner as to be capable of turning about the shaft of the switch arm and engaged with the other small gear, the swing gear being disposed between the other driven gear disposed at the other drive shaft and the intermediate gear engaged with this driven gear. Accordingly, the following effects can be obtained.

That is, in the drive apparatus for a vehicle toy according to the present invention, when the electric motor is rotated normally, one driving wheel is rotated normally by the drive gear firmly secured to one end of the rotary shaft supporting the electric motor through the large gear, one of the left-hand and right-hand small gears, one of the driven gears, one of the driving wheels, and one of the drive shafts, and at the same time, the other driving wheel is likewise rotated normally in the same direction as the one driving wheel, through the large gear, the remaining one of the small gears, the swing gear, the intermediate gear, the remaining one of the driven gears, and the remaining one of the drive shafts. As a result, the vehicle toy runs straight.

When the electric motor is rotated reversely, one driving wheel is rotated reversely by the drive gear through those members as in the normal rotation, and at the same time, the other driving wheel is rotated normally through the large gear, the other small gear, the swing gear, the other driven gear, and the other drive shaft. As a result, the vehicle toy makes a continuous turn. Since the radius of rotation for such a continuous turn or a U-turn can be made small when compared with the conventional toy in which one of the driving wheels is rotated and the other is kept stopped. Therefore, the vehicle toy can make a small turn.

Furthermore, the vehicle toy can be switched between a mode for running straight and a mode for making a continuous turn by rotating a single electric motor normally and reversely so as to bring, when in normal rotation, the swing gear engaged with the other small gear fixed to the large gear and rotatably supported by the switch arm into engagement with the other driven gear trough the intermediate gear, and to bring, when in reverse rotation, the swing gear into engagement directly with the other driven gear. Since an electromagnetic clutch and two electric motors are not used, the construction becomes simple.

Moreover, the switch arm is supported on the large gear and the left-hand and the right-hand small gears in such a manner as to be capable of turning about the shaft supporting these gears, the swing gear is rotatably attached to the switch arm in such a manner as to be capable of turning about the shaft of the switch arm, and the swing gear is engaged with the other small gear. Accordingly, in accordance with the normal or reverse rotation of the small gear, the swing gear is turned about the shaft of the switch arm while rotating about its axis and positively engaged with the intermediate gear and the driven gear. Therefore, a stable switching operation can be obtained.

The present invention is not limited to the above embodiment, and various modifications can be made without departing from the scope of the appended claim.

What is claimed is:

1. A drive apparatus for a vehicle toy comprising an electric motor capable of rotating normally and reversely, a transmission gear unit adapted to transmit the driving force of said electric motor to a left-hand and a right-hand drive shaft, and a pair of driving wheels, one each firmly secured to one end of said drive shafts, said transmission gear unit comprising a large gear engaged with a drive gear which is firmly secured to one end of a rotary shaft which supports said electric motor, a left-hand and a right-hand small gear respectively disposed at both sides of said large gear and integral with said large gear, two driven gears disposed one at said left-hand drive shaft and the other at said right-hand drive shaft, one of said driven gears disposed at either of said left-hand and said right-hand drive shaft being in constant direct engagement with either one of said corresponding left-hand and said right-hand small gears, a switch arm rotatably supported on a shaft which rotatably supports said large gear and said left-hand and right-hand small gears, and a swing gear rotatably supported on the switch arm in such a manner as to be capable of turning about a shaft of said switch arm and engaged with the other of the right-hand and left-hand small gear, said swing gear being selectively disposed between the other driven gear attached to the other drive shaft and, selectively, an intermediate gear rotatably engaged with said other driven gear, wherein when said electric motor is rotating normally, said switch arm will swing into a first position, thereby bringing said swing gear into engagement with said intermediate gear, thereby causing said pair of driving wheels to be driven in a same direction, and when said electric motor is rotating reversely, said switch arm will swing into a second position, thereby bringing said swing gear into direct engagement with said other driven gear and bypassing said intermediate gear, thereby causing said pair of driving wheels to be driven in opposite directions.

* * * * *